US005755035A

United States Patent [19]

Weatherly

[11] Patent Number: 5,755,035

[45] Date of Patent: May 26, 1998

[54] BLADE LOCK MECHANISM FOR FOLDING KNIFE

[75] Inventor: James S. Weatherly, Portland, Oreg.

[73] Assignee: Benchmade Knife Co., Inc., Oreg.

[21] Appl. No.: 754,313

[22] Filed: Nov. 21, 1996

[51] Int. Cl.[6] ..... B26B 1/04

[52] U.S. Cl. ..... 30/161; 30/160

[58] Field of Search ..... 30/160, 161, 331; 2/118–120

[56] References Cited

U.S. PATENT DOCUMENTS

| | | | |
|---|---|---|---|
| 996,235 | 6/1911 | Fuller . | |
| 1,647,405 | 11/1927 | Giesen . | |
| 4,425,709 | 1/1984 | Quenzi | 30/151 |
| 4,896,424 | 1/1990 | Walker | 30/349 |
| 5,093,995 | 3/1992 | Jan | 30/161 |
| 5,537,750 | 7/1996 | Seber et al. | 30/161 |
| 5,596,808 | 1/1997 | Lake et al. | 30/160 X |

*Primary Examiner*—Douglas D. Watts

*Attorney, Agent, or Firm*—Chernoff, Vilhauer, McClung & Stenzel

[57] ABSTRACT

A liner lock folding knife with an improved liner lock mechanism which can be manufactured satisfactorily by mass production techniques and conventional machine tools. A locking face surface engaged by a contact end of a locking finger is a concave partial cylinder whose central axis of curvature is located in a position offset with respect to the blade, in the direction toward the side of the handle from which the locking finger extends. The concave surface of the locking face has a radius of curvature smaller than the radius of curvature of the path of the contact end of the locking finger.

13 Claims, 4 Drawing Sheets

90
92
94
96
98
100
102
104
106
108
110
112
114
116
118
120
122
124
126
128
130
132
134
140
142
144
146
148
150
152
154
156
158
160
162
164
166
168
170
172
174
176
178
180
182
186
189
190
194
196
89
11

BLADE LOCK MECHANISM FOR FOLDING KNIFE

BACKGROUND OF THE INVENTION

The present invention relates to folding knives, and in particular to an improved blade locking mechanism for folding knives.

For several years some folding knives have included a locking mechanism known as a liner lock, in which a long finger-like portion of a liner plate within the handle of such a knife is bent to extend at a slight angle toward the blade of the knife. A free end of this locking finger is urged by its own elastic force to bear against a locking face on a tang of the knife blade when the knife is open, and the finger prevents the blade from being moved from a fully extended position.

Such a liner lock mechanism is disclosed, for example, in Walker U.S. Pat. No. 4,896,424, where it is shown that the tang of the blade is shaped to provide a flat ramp surface at an angle of 9° from perpendicular to the plane of the blade in order to make the locking mechanism self-adjusting as the moving parts of the knife wear.

Liner lock knives have typically been made with that angle within the range of 8° to 12° from perpendicular. A greater variance from perpendicular may allow the ramp to cam the locking finger out of engagement when pressure is exerted against the back of the blade, allowing the blade to close, with possible serious injury resulting to the user of the knife. If the angle chosen is too small, however, it is possible for the locking finger to become wedged tightly against the ramp surface on the locking tang of the knife blade, making it undesirably difficult to release the blade so that it can be folded.

In order to allow for a maximum amount of variability in the manufacturing process and for wear to take place during the lifetime of such a liner lock mechanism, in a new knife the ideal position for the locking finger places its inner surface at the center of the knife blade. Buyers of high-quality liner lock knives have come to demand such a relationship between the locking finger and the blade, but because of the many variable dimensions involved, it has previously been customary to allow a variance from the ideal position of as much as plus one-half of the thickness of the locking finger. Thus, for a liner lock knife locking finger and liner made of material 0.040 inches thick the total range of positions allowable for the locking finger is only 0.020 inch.

Several dimensions of various parts of a liner lock folding knife all affect the eventual relative positions of the end of the locking finger and the locking face on the tang of the knife blade. Such dimensions include:

1. the diameter of the blade pivot pin relative to the diameter of the pivot hole in the blade;
2. the diameter of the blade pivot pin relative to the diameter of the hole in which it fits in the liner plate;
3. the diameter of the blade stop pin relative to the diameter of the blade stop pin hole in the liner;
4. the position of the blade stop pin hole in the liner relative to the position of the blade pivot pin hole in the liner;
5. the location of the part of the surface of the blade which contacts the blade stop pin, relative to the location of the pivot hole in the blade;
6. the position of the locking surface of the blade relative to the position of the pivot hole in the blade;

7. the position of the contact surface of the locking finger relative to the position of the blade pivot pin hole in the liner;
8. the effective length of the locking finger between its contact end and the point at which it is bent out of the plane of the liner;
9. the radius of the bend in the locking finger.
10. the thickness of the axial spacer on the blade pivot pin between the blade and the liner; and
11. the angle of inclination of the locking face of the blade.

Assuming a 10° angle of inclination of the locking face and a total allowable position tolerance of 0.020 inch along the locking face, the total tolerance in the position of the locking surface of the blade, in the direction toward the contact end of the locking finger, is 0.00353 inch, which allows an average of only 0.000353 inch for the effects of each of the mentioned possible sources of error other than the angle of inclination.

The cost of equipment and tooling which will consistently result in parts remaining within such close tolerances is extremely high compared to the cost of conventional machining equipment. As a result, in the past, either the standard of quality of knives has been lowered by allowing greater deviation from the desired fit, or such liner lock folding knives have had to be custom made in small batches. High quality liner lock folding knives have therefore been very expensive to produce. What is desired, then, is an improved blade locking mechanism for folding knives which will allow the variability associated with normal production methods for the parts while still maintaining the desired variation of relative positions of not more than one-half a liner thickness in the final position of the locking finger, thus making it possible for consistently high quality knives to be produced using mass production methods and at lower cost.

BRIEF SUMMARY OF THE INVENTION

The present invention provides an answer to the aforementioned shortcomings of the prior art by providing an improved blade locking mechanism for a folding knife which makes it possible to manufacture such knives having high quality, yet with greater tolerance for dimensional variations in the various parts of the knife. In a folding knife according to the present invention, a concave locking surface is provided on the blade, to be engaged by a contact end of a locking finger. Such a locking surface has a radius of curvature smaller than the radius of curvature of the path of the contact end of the locking finger as it comes to bear against the locking surface to hold the knife blade in its extended position.

Because the locking surface of the blade is concave, rather than a planar surface oriented at a particular angle, when the contact end of the locking finger engages the locking surface with the desired alignment between the locking finger and the knife blade, further movement across the locking surface is prevented by an increasing steepness of slope of the locking surface. As a result, variance in the dimensions of the parts of the knife which are factors in the position of the contact end relative to that of the locking surface, because of either manufacturing tolerances or wear, results in a smaller variation of the position of the contact end on the locking surface than would be the case were the contact surface a planar ramp surface as in the prior art.

Preferably, a central axis of curvature of the concave locking surface of the knife blade is flush or offset laterally with respect to the knife blade, in the direction toward the side from which the locking finger extends toward the blade.

In a preferred embodiment of the invention the locking surface is a portion of a right circular cylinder whose central axis is inclined at a small angle with respect to a line perpendicular to an imaginary plane including the path of the contact end of the locking finger.

In another embodiment of the invention a locking finger is a separate part attached to the interior of the handle of the knife.

In yet a further embodiment of the invention a locking finger includes a contact surface extending generally parallel with the length of the open blade, and the base of the blade includes a concave locking surface also extending generally parallel with the length and thickness of the blade.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
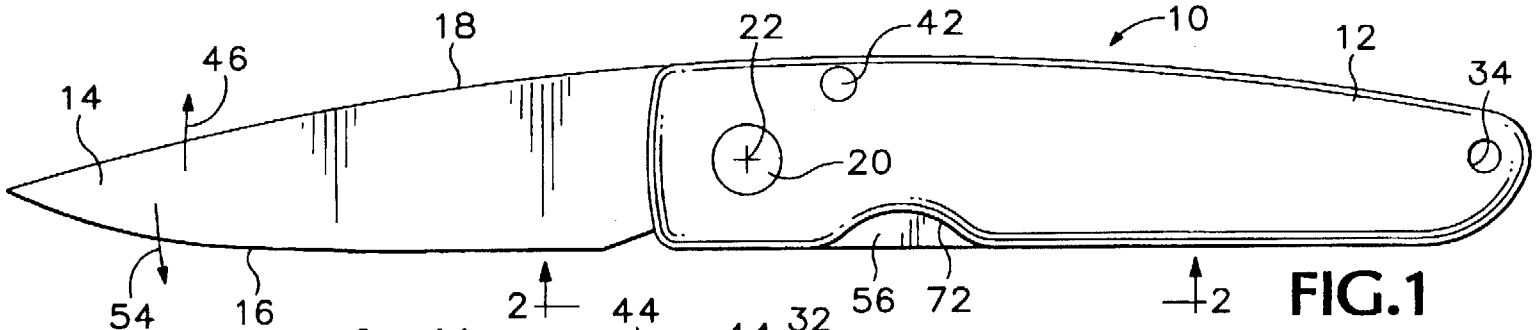
FIG. 1 is a side view of a folding knife according to the present invention, with its blade in a fully-extended position.
Figure 3:
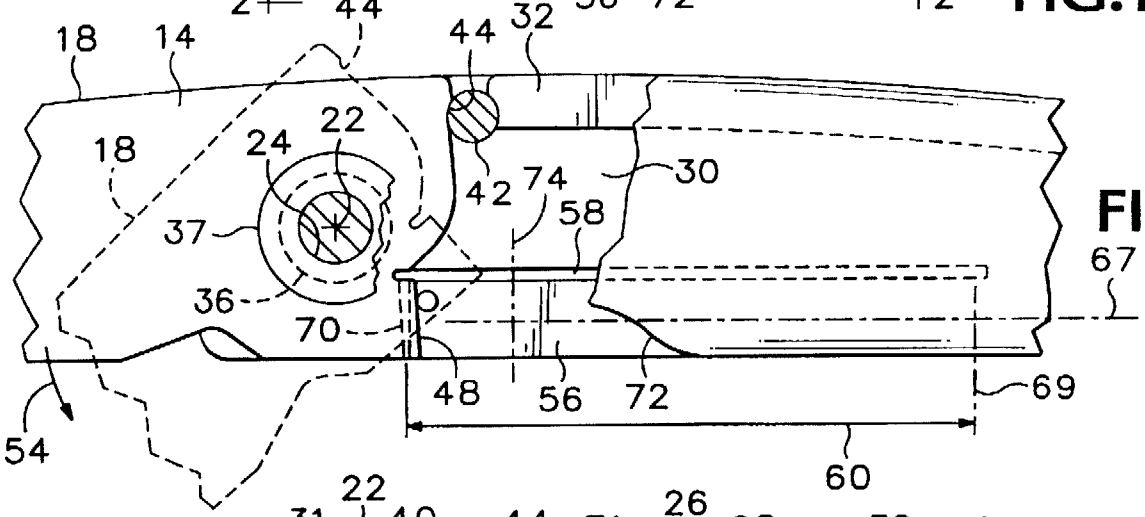
FIG. 3 is a partially sectional view of a portion of the knife shown in FIG. 2, taken along line 3—3 at an enlarged scale, showing the liner lock mechanism holding the blade in its extended position.
Figure 2:
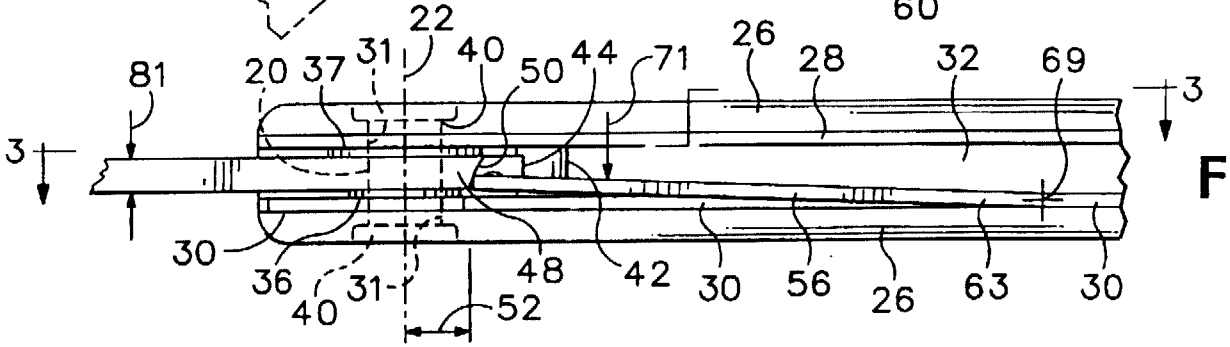
FIG. 2 is a bottom view of a portion of the folding knife in FIG. 1, showing a portion of the blade and the liner lock mechanism which holds the blade in its extended position, at an enlarged scale.

Referring now to the drawings which form a part of the disclosure herein, a folding knife 10 shown in FIG. 1 includes a handle 12. A blade 14 has a cutting edge 16 and a back 18 and may be of a well-known knife blade metal such as ATS-34 steel. The blade 14 is interconnected with the handle 12 through a blade pivot arrangement including a pivot pin 20 defining a blade pivot axis 22. A base portion of the blade 14 defines a pivot hole 24 through which the pivot pin 20 extends. Preferably, a minimum of clearance is available between the pivot pin 20 and the pivot hole 24, allowing the blade 14 to pivot about the pivot pin 20 smoothly, and without either binding or looseness.

Referring also to FIGS. 2–5, a pair of handle face plates 26 are provided on the opposite sides of the handle 12, and a pair of liners 28 and 30 of sheet metal are provided on respective opposite sides of the blade 14, between the face plates 26. The pivot pin 20 is fitted into respective pivot pin holes 31 provided in the liners 28 and 30 to establish the location of the pivot axis 22. A filler plate 32 is held tightly between the liners 28 and 30, where it is retained by an end bolt 34 and alignment pins (not shown) located at positions spaced along the handle 12.

Washers 36 and 37 are located, respectively, on opposite sides of the base portion of the blade 14, circumscribing the pivot pin 20, and act as axial spacers between the blade 14 and the respective liner 28 or 30. The pivot pin 20 includes a pair of opposite heads 40 spaced apart from each other axially by a distance which holds the washers 36 and 37, liners 28 and 30, and handle face plates 26 snugly together while still permitting the blade 14 to pivot about the pivot pin 20 without an undesirably great amount of friction.

A stop pin 42 extends through the handle 12, parallel with the pivot pin 20, in a location chosen so that a surface of a heel portion 44 of the base of the blade 14 comes into contact with the stop pin 42 to limit movement of the blade 14 in a blade-extending direction, indicated by the arrow 46, as the blade 14 moves about the pivot axis 22 to its fully-extended position.

A locking tang 48 is also located in the base portion of the blade 14, on the opposite side of the blade pivot axis 22 from the heel 44. The locking tang 48 has a face including a locking surface 50 that is offset from the blade pivot axis 22 by a distance 52 small enough to provide clearance for the locking tang 48 to pass by the stop pin 42 as the blade 14 is moved, in the direction indicated by the arrow 54, towards a folded position in which the blade 14 is stowed in the handle 12 within a space defined between the liners 28 and 30.

A locking finger 56 is an integral extension of the right, or far side, liner 30, defined by a slot 58 establishing a length 60. The liner 30 is preferably laser cut from a sheet of a suitable metal such as type 410 stainless steel having a thickness 62 of 0.040 inch, for example. The locking finger 56 is bent inward at its base 63, toward the blade 14, whose right side (closer to the liner 30) defines a blade plane 64 generally parallel with a liner plane 66 defined by the liner 30. The entire liner 30, including the locking finger 56, is heat treated to give the locking finger 56 a desired degree of resiliency as a spring. The locking finger 56 is thus free to move resiliently, parallel with an imaginary plane 67, in the directions indicated by the double-headed arrow 68, so that a contact end 70 moves in a path approximately normal to the liner plane 64 and thus swings about an imaginary pseudo pivot axis 69 located near the base 63 where the locking finger 56 is bent from the liner plane 66.

With the blade 14 in its extended position as shown in FIG. 1, a contact surface 73 on the contact end 70 of the locking finger 56 rests against the locking surface 50, preventing the blade 14 from moving in the direction of the arrow 54 toward a folded position. The contact surface 73 is oriented transverse to the length 60 of the locking finger so that pressure exerted by the locking surface 50 is directed substantially directly along the length 60 of the locking finger 56. The elastic force of the locking finger 56 urges the contact end 70 away from the liner plane 66 and thus urges the contact surface 73 toward the locking surface 50, keeping the blade 14 locked in its extended position.

The locking surface 50 consists principally of a concave, cylindrical surface, preferably a portion of a right circular cylinder having a cylinder axis or axis of curvature 74 located in a position offset laterally from the center of the blade 14 toward the near side of blade 14. The axis 74 is preferably located beyond the blade plane 64 in the direction of the liner plane 66.

Figure 5:
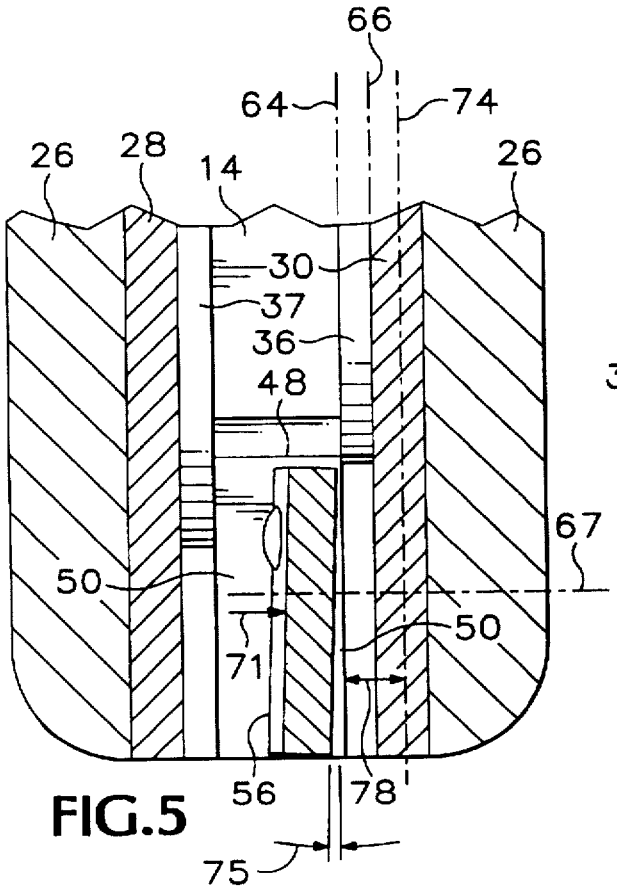
FIG. 5 is a detailed view, at an enlarged scale, taken along line 5—5 of FIG. 4.
Figure 6:
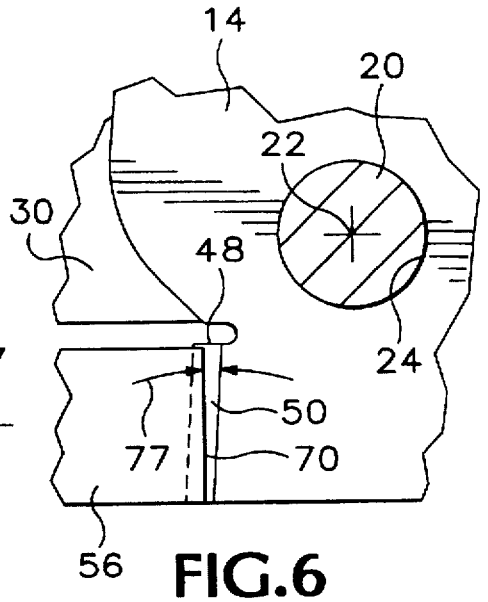
FIG. 6 is a side elevational view on line 6—6 of FIG. 4, showing a detail of a locking mechanism which is a slightly different embodiment of the invention.

As shown best in FIG. 5, the locking finger, at least at its contact end 70, is preferably tilted at a slight angle 75 (for example, about 1°) away from parallel with the blade plane 64 so that the part of the contact surface 73 that is furthest from the pivot axis 22 is first to come into contact with the locking surface 50. As will be understood, this gives the best mechanical advantage available to hold the blade 14 in its extended position. Alternatively, the cylinder axis 74 may be tipped slightly in the plane of the blade 14, as shown in FIG. 6, away from parallel with the contact end 70, for the same reason, with an angle 77 being about 1°, for example.

When it is desired to fold the blade 14 into its folded position it is necessary to push the locking finger 56 in the direction of the arrow 71. The locking finger 56 is exposed for application of such pressure by a cut-out 72 defined in the handle 12, as shown in FIG. 1.

In one embodiment of the invention the locking surface 50 is a portion of a right circular cylinder having a radius 76 of about 0.5 inch, with its central axis 74 located at a position offset laterally from the blade plane 64 by a distance 78 of about 0.06 inch, while the locking finger 56 has an effective length 60, or radius of curvature of the path of the contact end 70, of about 1.20 inch from the pseudo axis 69 to the contact end 70.

Figure 4:
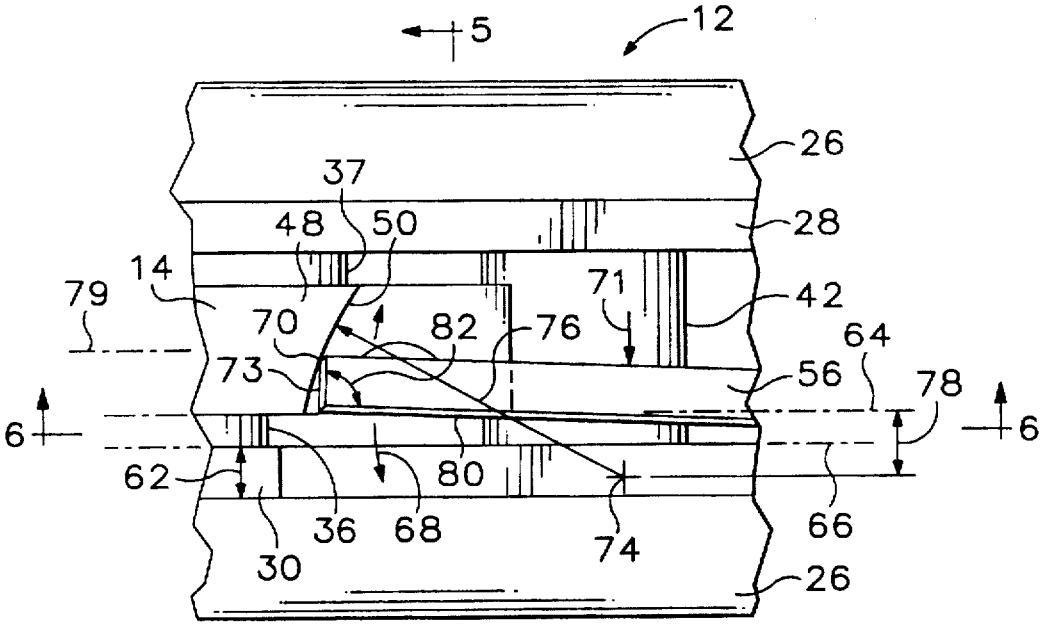
FIG. 4 is a view of a detail of the liner lock mechanism of the knife shown in FIG. 1, taken in the same direction as FIG. 2, at a further-enlarged scale.

The concave, arcuate shape of the locking surface 50, with a radius of curvature 76 smaller than the effective length 60 of the locking finger 56, results in a significant reduction of the precision required in manufacture of the knife 10 to provide a satisfactory fit between the locking finger 56 and the locking surface 50, so that the inner side 71 of the locking finger 56 is located on the center-line 79 of the blade as shown in FIG. 4, when the blade 14 is locked in its extended position. It is understood that the pivot pin 20, pivot hole 24, locking surface 50, and contact end 70 may wear away during the lifetime of the folding knife 10. Nevertheless, because the radius 74 of curvature of the surface of the locking surface 50 is less than the radius of curvature of the path of the contact end 70, and because the location of the axis of curvature 74 is offset laterally, from the center of the blade 14 at least to the blade plane 64, the contact surface 73 continues to rest against the locking surface 50, securely locking the blade 14 in its extended position, without danger of force on the blade 14 in the direction of the arrow 54 causing the locking surface 50 to cam the contact surface 73 of the locking finger 56 toward the liner 30, and without the contact surface 73 becoming wedged against the locking face 50 and causing difficulty in pressing the locking finger 56 toward the liner 30 when it is desired to release the blade 14.

While the shape and location of the locking face 50 mentioned hereinabove have been found to be satisfactory in one embodiment of the invention, in which the liner 30 and the locking finger 56 are of stainless steel having a hardness of 40 (Rockwell C), in which the blade 14 is made of ATS-34 steel and has a thickness 81 of 0.100 inch, and in which the pivot pin 20 is of stainless steel also of approximately 40 (Rockwell C) hardness, it will be understood that when using other materials which have different properties of resistance to wear, or different coefficients of friction with respect to each other, it may be desirable to locate the axis of curvature 74 at a different position and for the radius of curvature 76 to be greater or smaller to achieve optimum results, so long as the radius of curvature 76 is appreciably smaller than the radius of curvature of the path of the contact end 70 of the locking finger 56.

In one manner of manufacturing the knife 10 according to the present invention, a laser cutter is used to form the liner 30 and locking finger 56, with the result that the contact surface 73 is not exactly perpendicular to the liner plane 66, but may form with it an interior angle 82 of about 89°. If the angle 82 differs more from exactly 90°, a greater distance 78, by which the axis of curvature 74 is offset from the blade plane 64, is ordinarily desired.

Figures 7, 8, 9:
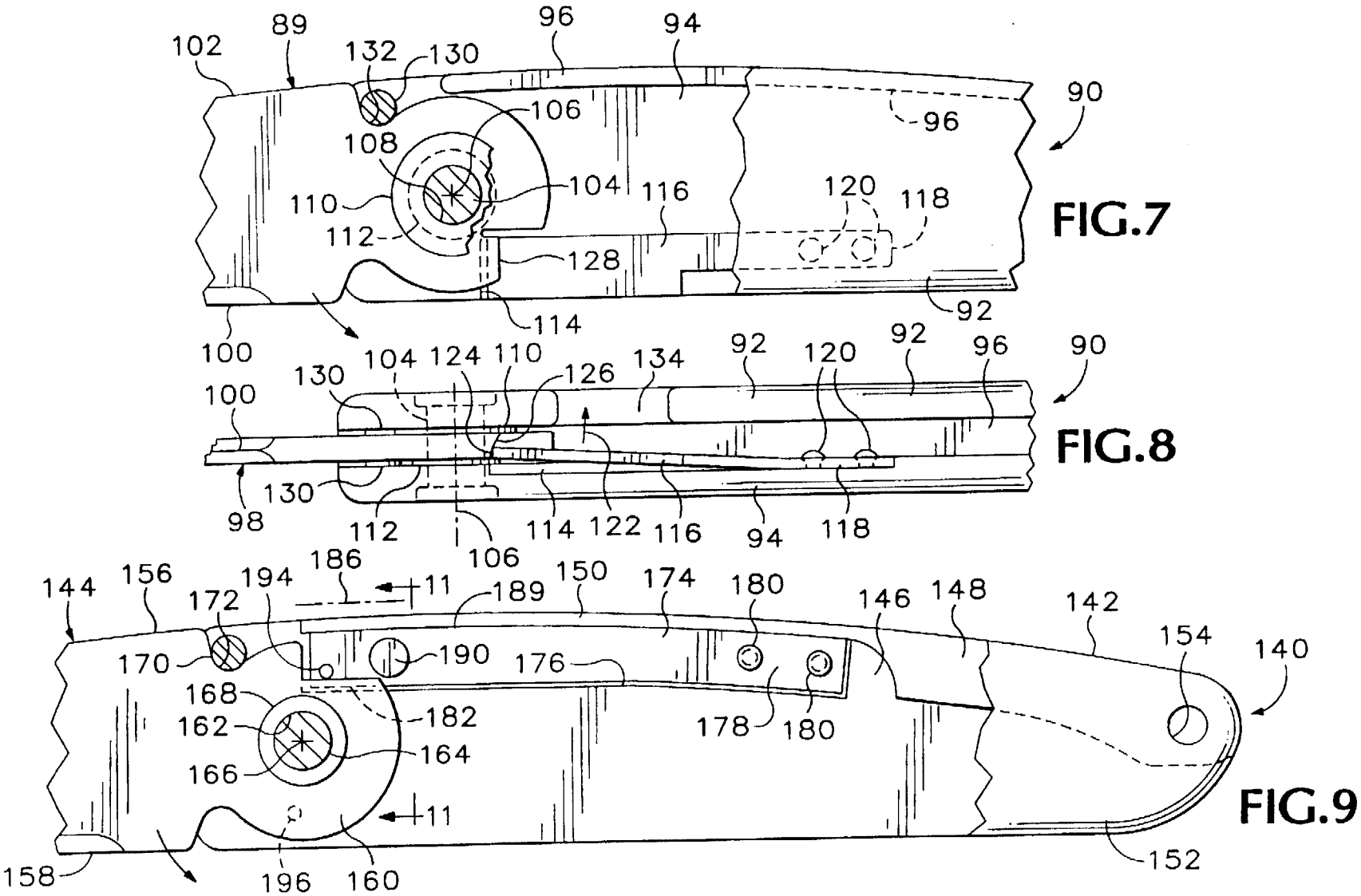
FIG. 7 is a partially cut-away side elevational view of a knife similar to that shown in FIGS. 1–6, in which the locking finger is a separate piece attached to a liner of the knife handle.
FIG. 8 is a bottom plan view of the portion of a knife shown in FIG. 7.
FIG. 9 is a partially cut-away side elevational view of a knife which is an alternative embodiment of the present invention.

As shown in FIGS. 7 and 8, a knife 90 which is another embodiment of the invention has a handle including a first side piece 92, shown partially cut away in FIG. 7, and a second side piece 94, preferably including a back spacer or filler portion 96, corresponding to the filler plate 32 in the knife 10. The knife 90 includes a blade 98 with a cutting edge 100 and a back 102. The blade 98 is mounted on a pivot pin 104 defining a pivot axis 106, and the base of the blade 98 defines a pivot hole 108 which fits about the pivot pin 104. Washers 110 and 112 keep the blade 98 located centrally between the handle pieces 92 and 94, as may be seen best in FIG. 8.

The handle parts 92 and 94 may be of cast or machined metal such as aluminum, or of a suitable reinforced plastic material such as a strong glass fiber-reinforced plastic material known as G10, or a nylon fiber-reinforced plastic, such as a well-known material available under the trademark ZYTEL.

A recess 114 is machined or molded into the handle side 94, depending upon the material of which the handle is made, and a locking finger 116 is mounted in the recess 114, with a base 118 of the locking finger 116 being attached securely to the handle side 94 by fasteners such as a pair of rivets 120. The locking finger 116, as the locking finger 56, is preferably made of a corrosion resistant spring metal such as a type 410 stainless steel, and is shaped to be urged by its own elasticity in the direction indicated by arrow 122, that is, toward the first handle side piece 92, and thus toward the blade 98.

As with the locking finger 56, the locking finger 116 has a contact surface 124, corresponding to the contact surface 73, which is brought to bear against a locking face 126 located on a locking tang 128 of the blade 98. As with the locking face 50, the locking face 126 is concave, preferably in the shape of a sector of a circular cylinder, and the contact surface 124 cooperates with the locking face 126 in the same manner as does the contact surface 73 with the locking face 50, so that the locking action provided in the knife 90 is substantially the same as that in the folding knife 10, except that the locking finger 116 is fastened to the side piece 94 of the handle directly instead of being an integral part of a liner.

When the blade 98 is in its extended, or open, position, as shown in FIGS. 7 and 8, a stop pin 130 is in contact with a heel surface 132, and thus prevents the blade 98 from moving relative to the handle 90 in response to the force of cutting. An access cutout 134 is preferably provided in the handle part 92 to facilitate pressing against the locking finger 116. The stop pin 132 encounters a surface 136 on the base of the blade 98, limiting movement of the blade 98 on closing.

Figure 10:
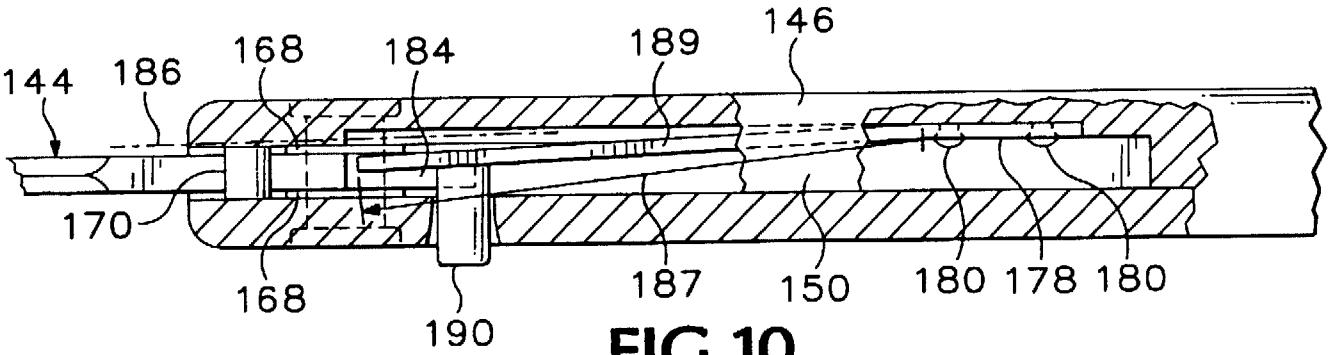
FIG. 10 is a partially cut-away top plan view of the portion of a knife shown in FIG. 9.
Figure 11:
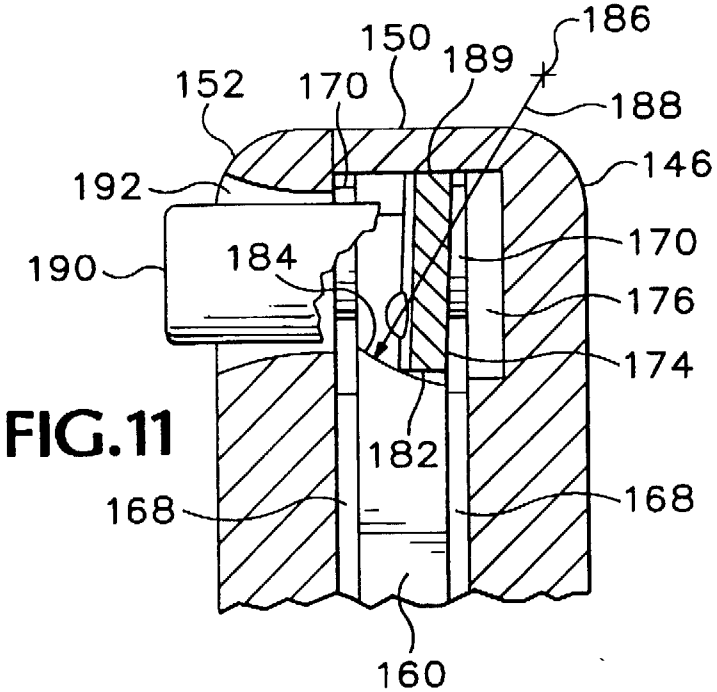
FIG. 11 is a section view taken along line 11—11 of FIG. 9, at an enlarged scale.

A folding knife 140 which is another alternative embodiment of the present invention is shown in FIGS. 9, 10, and 11 and includes a handle 142 and a blade 144. The handle 142 has a right, or rear, side member 146, which includes as an integral part a central spacer or filler 148 having a relatively thin back portion 150 that extends along the portion of the handle 142 closer to the blade 144. A left or near side 152 of the handle fits matingly against the filler 148 and is attached securely to it by one or more fasteners such as a rivet 154. The filler 148 thus separates the right and left side pieces 146 and 152 of the handle to define a space between them to receive the blade 144 in the closed, or folded, configuration of the knife 140.

The blade 144 includes a back 156 and a cutting edge 158, and has a base portion 160 which defines a pivot hole 162 which fits about a pivot pin 164 extending transversely of the handle 142 and defining a pivot axis 166 about which the blade 144 rotates between its extended position, shown in FIGS. 9, 10, and 11, and a closed position (not shown). A pair of washers 168 are mounted on the pivot pin 164, one between each side of the blade 144 and the respective one of the right and left sides 146 and 152 of the handle, to keep the blade 144 centrally located between the sides 146 and 152 of the handle. A stop pin 170 also extends between the right and left sides 146 and 152 of the handle 142 and rests against a heel surface 172, located between the back 156 and the base portion 160 of the knife blade 144.

A locking mechanism related to those of the folding knife 10 and the folding knife 90 is also present in the folding knife 140. A locking finger 174 is attached to the right side 146 of the handle, within a recess 176, where a base portion 178 of the locking finger 174 is attached to the right side 146 of the handle by fasteners such as a pair of rivets 180. The locking finger 174 is bent to extend at a slight angle away from parallel with the right side 146 of the handle, toward the base 160 of the blade 144. With the blade 144 in the open position as shown in FIGS. 9, 10, and 11, a contact surface 182 on the bottom of the locking finger 174 rests on a concave locking face 184, with the locking finger 174 held in position by its own elastic bias.

The locking face 184 is preferably a concave portion of a cylindrical surface centered on an axis 186 extending generally parallel with the length of the blade 144 and the locking finger 174, and offset laterally with respect to the blade 144, in the direction toward the locking finger 174, as shown in FIGS. 10 and 11. Preferably, the radius 188 of curvature of the locking face 184 is about 0.5 inch, as in the locking face 126 and the locking face 50 described previously, while the length of the locking finger 174 is, for example, about 2.0 inches so that its contact end moves through an arc having a radius 187 of about 1.5 inches. To counteract against forces tending to rotate the blade 144 toward the folded position, the rivets 180 or corresponding other fasteners are assisted in resisting any force of the locking face 184 exerted against the contact surface 182 by the support given to the upper side 189 of the locking finger 174 by the inner surface of the back portion 150.

A release button 190 is attached to the locking finger 174 and extends laterally toward the left side 152 of the handle, which preferably defines a cut-out or opening 192 through which the release button 190 extends to be pressed rightward, as seen in FIG. 11. Pressing the release button 190 moves the locking finger 174 and thus releases the contact surface 182 from the locking face 184 to permit the blade 144 to be moved to the folded position by moving in a counterclockwise direction about the pivot axis 166, as seen in FIG. 9. A raised detent bump 194 on the near, or left, side of the locking finger 174 is urged into a shallow detent hole 196 defined in the far, or right, side of the base 160 to retain the blade 144 in the folded position.

It will be understood that mirror-image, opposite-handed versions of the folding knives 10, 90 and 140 are possible.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A liner lock folding knife comprising:

(a) a handle;

(b) a blade hating a side defining a blade plane and including a locking face consisting principally of a concave surface having an axis of curvature oriented approximately parallel with said blade plane;

(c) a blade pivot interconnecting said blade with said handle and defining a blade pivot axis substantially normal to said blade plane, said blade being movable about said blade pivot axis, between a folded position and an extended position; and (d) a locking finger located in said handle and having a contact end engaging said locking face and holding said blade in said extended position.

2. The folding knife of claim 1 wherein said concave surface of said locking face is substantially cylindrical.

3. The folding knife of claim 1 wherein a principal portion of said concave surface of said locking face is a portion of a cylinder and said axis of curvature is a cylinder axis of said cylinder.

4. The folding knife of claim 3 wherein said cylinder is a right circular cylinder.

5. The folding knife of claim 3 wherein said handle includes a liner and said locking finger is a part of said liner, said locking finger having a length and said cylinder having a radius that is less than said length.

6. The folding knife of claim 5 wherein said radius is less than one inch.

7. The folding knife of claim 6 wherein said cylinder axis is inclined slightly with respect to said blade plane.

8. The folding knife of claim 6 wherein said radius is about 0.5 inch.

9. The folding knife of claim 3 wherein said handle includes a liner and said locking finger is an integral part of said liner, said liner defining a liner plane spaced apart from said blade plane in a first direction and said cylinder axis being spaced apart from said blade plane in said first direction.

10. The folding knife of claim 1 wherein said locking finger has a length and said locking face has a radius of curvature that is less than half of said length.

11. The folding knife of claim 1 wherein said locking finger is a separate piece attached to said handle.

12. The folding knife of claim 1 wherein said blade has a length and said locking finger has a length, said lengths being substantially parallel when said blade is in said extended position, said locking face being substantially parallel with said length of said blade, and said contact end including a contact surface oriented substantially parallel with said length of said locking finger.

13. The folding knife of claim 12 wherein said handle includes a back portion extending along said length of said locking finger in position to support said locking finger against force exerted by said locking surface on said contact surface in a direction substantially toward said back portion.

* * * * *